US006125855A

United States Patent [19]

Nevett et al.

[11] Patent Number: 6,125,855

[45] Date of Patent: Oct. 3, 2000

[54] PROCESS FOR EXPANDING TOBACCO

[75] Inventors: Robert Nevett, Whitchurch; Clifford Hendrik Henneveld, Oldland Common; Keith Alan Matthews, Longwell Green; Brian Chester Chard, Nortonhawkfield, all of United Kingdom

[73] Assignee: Imperial Tobacco Limited, United Kingdom

[21] Appl. No.: 09/117,427

[22] PCT Filed: Feb. 4, 1997

[86] PCT No.: PCT/GB97/00304

§ 371 Date: Oct. 20, 1998

§ 102(e) Date: Oct. 20, 1998

[87] PCT Pub. No.: WO97/28706

PCT Pub. Date: Aug. 14, 1997

[30] Foreign Application Priority Data

Feb. 8, 1996 [GB] United Kingdom ..... 9602575

[51] Int. Cl.[7] ..... A24B 3/18; A24B 1/02

[52] U.S. Cl. ..... 131/296; 131/291; 131/301; 131/300; 131/900

[58] Field of Search ..... 131/296, 291, 131/901, 902, 294, 301, 300

[56] References Cited

U.S. PATENT DOCUMENTS

| | | | |
|---|---|---|---|
| 3,575,178 | 4/1971 | Stewart | 131/296 |
| 3,683,937 | 8/1972 | Fredrickson et al. | 131/296 |
| 3,753,440 | 8/1973 | Ashburn | 131/296 |

*Primary Examiner*—James Derrington
*Assistant Examiner*—Dionne A. Walls
*Attorney, Agent, or Firm*—Larson & Taylor PLC

[57] ABSTRACT

Tobacco is treated to cause its expansion by a process which comprises the steps of subjecting it, in a treatment chamber, to a reduced pressure of not greater than 7 kPa, impregnating the cell structure of the tobacco with isopentane vapour at a temperature in the range of from 70° C. to 100° C. and maintaining the tobacco in contact with the vapour at a pressure of at least 400 kPa, removing excess isopentane vapour from the treatment chamber, contacting the impregnated tobacco with steam to expand the tobacco cell structure, reducing the pressure in the treatment chamber at a rate of at lest 10 kPa/minute, preferably 30 kPa/minute, and then venting the treatment chamber back to atmospheric pressure. The final filling value of the tobacco treated according to this process is directly proportional to the rate at which the pressure in the treatment chamber is reduced following the steam treatment of the tobacco.

5 Claims, 3 Drawing Sheets

PROCESS FOR EXPANDING TOBACCO

Figure 1:
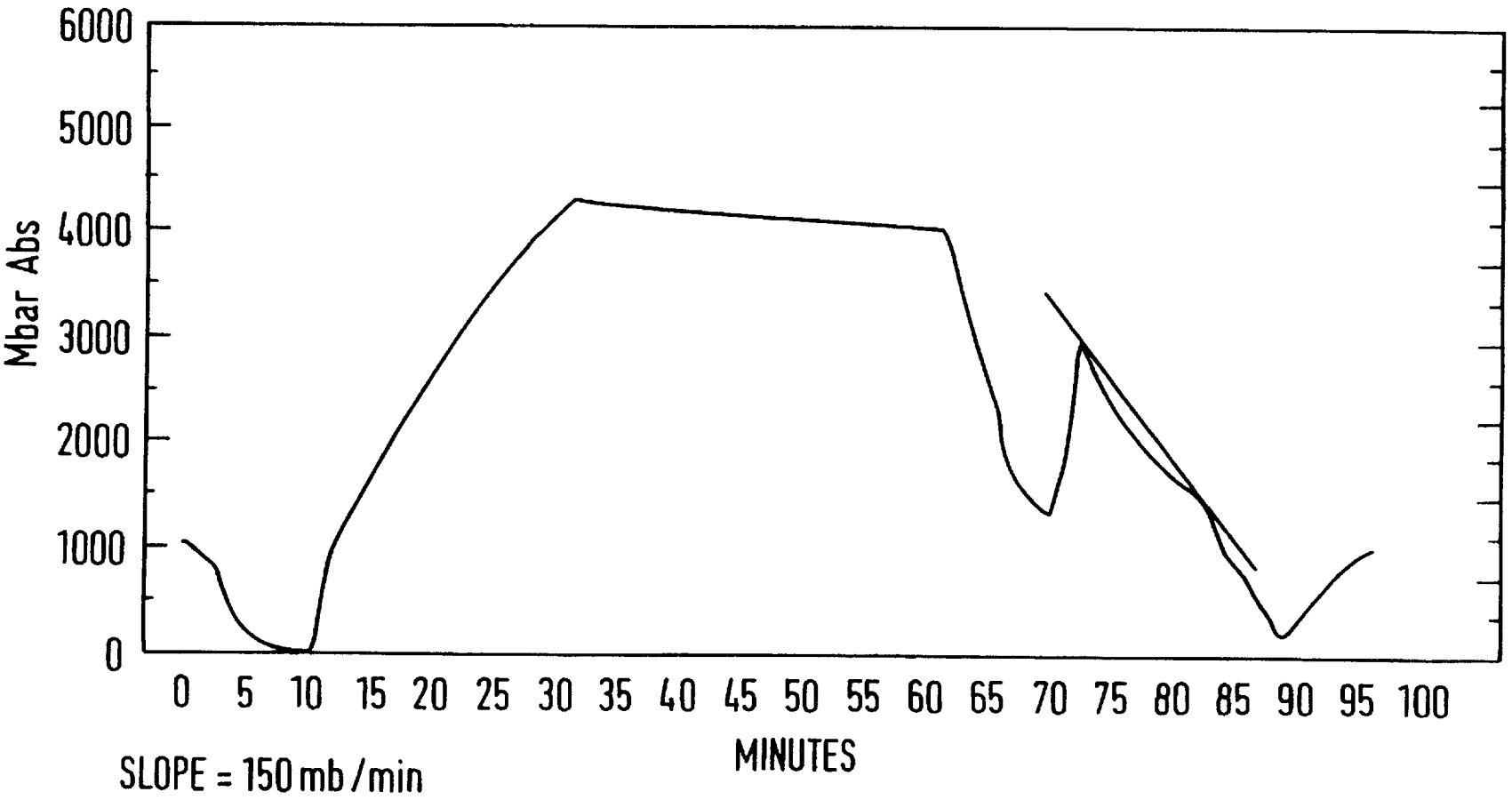

The present invention relates to a process for treating tobacco. More particularly, it relates to a process for expanding tobacco to increase its filling capacity.

Tobacco leaves, after harvesting, are subjected to curing processes. As a result of water loss suffered during the curing process, the leaves undergo variable shrinkage. It is conventional practice in the tobacco industry to treat cured tobacco intended for cigar or cigarette manufacture to recover the shrinkage by increasing its filling capacity. It is generally considered that by treating the tobacco in this way the cellular structure of the cured tobacco leaf is expanded to a state similar to that found in the leaf prior to curing.

A number of processes exist for increasing the filling capacity of tobacco. These are widely used within the industry to achieve product recovery after curing. The present invention is based on the discovery that filler expansion levels similar to and sometimes better than those achieved by conventionally used expansion processes and hence recovery can be achieved by the use of isopentane as the expansion medium in the vapour phase in a carefully controlled process.

Accordingly, the invention provides a process for treating tobacco comprising the series of steps:

(1) subjecting in a chamber the tobacco to a reduced pressure of not greater than 70 mbar (7 kPa);
(2) introducing, into the chamber, isopentane vapour at temperature in the range of 70° C. to 100° C. and maintaining the tobacco in contact with isopentane vapour at a pressure of at least 4 bar (400 kPa) to cause impregnation of the tobacco structure;
(3) removing excess isopentane vapour by depressurising the chamber, without causing damage to the structure in the tobacco;
(4) contacting the impregnated tobacco with steam to expand the tobacco;
(5) reducing the pressure in the chamber at a rate of at least 100 mbar/minute (10 kPa/minute); and
(6) venting the chamber back to atmospheric pressure.

The tobacco which is treated according to the process of the invention will typically be in the form of pieces of cured tobacco leaf obtained by threshing, failing or slicing whole cured leaves. The tobacco may alternatively be in the form of strips cut from whole leaf or may be shredded leaf. The tobacco to be treated will typically be arranged in baskets in the processing chamber.

The cured tobacco is, according to the present invention, subjected to a reduced pressure of not greater than 70 mbar (7 kPa) i.e., to a pressure, in the chamber, of 70 mbar or lower. By this treatment, air in the processing chamber and air retained in pockets between tobacco leaf pieces or within the cell structure which would otherwise interfere with the subsequent impregnation of the cellular structure by the isopentane vapour is removed. The application of a pressure above 70 mbar does not sufficiently remove occluded air in the tobacco and, as a result, the subsequent impregnation of the tobacco cellular structure by isopentane vapour is impaired. Preferably, the pressure in the chamber is reduced to below 25 mbar (2.5 kPa), more preferably to about 10 mbar (1 kPa), to remove air from within the tobacco structure to enable optimum replacement by isopentane vapour in the subsequent stage of the process. Isopentane vapour is then pumped into the processing chamber. It is important in the invention that no liquid isopentane is allowed to enter the process chamber. Therefore, liquid isopentane stored outside the process chamber is injected in the chamber through a vaporiser which forms isopentane vapour at between 70° C. and 100° C. before it is able to come into contact with the tobacco. Since isopentane is a highly volatile and flammable solvent, engineering design of the process and recovery system must be carefully undertaken. The temperature of the isopentane vapour entering the chamber will be in the range of from 70° C. to 100° C. although on contacting the tobacco in the chamber the temperature may be reduced to from 60° to 80° C. Isopentane vapour having a temperature greater than 100° C. should not be introduced into the chamber since it impairs the subsequent steam expansion treatment and does not enable sufficient expansion of the tobacco to be achieved. Furthermore, if the vaporiser is set to produce isopentane vapour at a temperature less than 70° C. there is a risk that liquid isopentane might pass through and enter the process chamber. Isopentane vapour at a temperature lower than 70° C. might, on entering the chamber, be cooled by the contents of the chamber to the extent that it condenses. The effect of allowing liquid isopentane into the process chamber is to disrupt the process. Firstly, any liquid isopentane present in the chamber will take energy out of the system as it evaporates. Secondly, the energy requirements of the excess isopentane recovery procedures will be increased.

The amount of isopentane impregnating the cells in the tobacco leaf is controlled by the pressure of isopentane vapour created in the process chamber. The isopentane vapour is injected into the chamber until an internal pressure of at least 4000 mbar (400 kPa), preferably up to 5200 mbar (520 kPa), is achieved. When this pressure value is reached, the chamber is sealed after which the internal pressure may continue to rise as the temperature of the isopentane vapour continues to rise. The tobacco is then maintained in contact with isopentane vapour at a pressure of at least 4000 mbar (400 kPa) and temperature typically in the range of from 60° C. to 80° C. to allow complete penetration of the tobacco leaf cells by the isopentane to occur. We have found that good levels of expansion of the tobacco can be achieved by maintaining the tobacco in contact with the high pressure isopentane vapour for a period in excess of about 30 minutes. Preferably, at the pressure used the tobacco is maintained in contact with the isopentane vapour for a period of from 40–50 minutes. This period causes the vapour to be impregnated into the tobacco structure.

As soon as this time period has elapsed all excess isopentane vapour is removed from the chamber by reducing the pressure in the chamber as quickly as possible, preferably to a value in the range of from 1000 to 1500 mbar (100–150 kPa), without causing any substantial disruption or breakage of the cellular structure of the tobacco. Substantial disruption or breakage of the cellular structure at this stage in the process would be catastrophic since subsequent expansion of the tobacco would be impaired or even prevented. We have found that this pressure reduction can be achieved in 10–20 minutes, typically about 15 minutes.

Immediately following the depressurisation of the chamber as described above steam is introduced into the chamber. The temperature of the impregnated tobacco is caused to increase rapidly by contacting the tobacco with the steam. As a consequence of this rise in temperature, the isopentane bound inside the tobacco cell structure undergoes a volume increase causing the cellular structure of the tobacco to expand. As the steam is introduced the pressure in the chamber rises to a level typically not greater than 3000 mbar (300 kPa) and preferably within the range of from 2200 to 3000 mbar (220–330 kPa). A rapid temperature rise in the tobacco is required in order to achieve effective expansion.

Care should be taken with the introduction of the steam so as not to create avoidable turbulence inside the chamber which would have a detrimental effect on the tobacco expansion. When the chamber pressure, during steam introduction, has reached the level indicated above the introduction of the steam is discontinued. Steam and isopentane vapour, which is released from the tobacco cell structure during expansion thereof, is withdrawn from the chamber into condenser equipment within the plant. This equipment consists of a condenser through which cold water is passed. The efficiency of the condenser, which affects the rate of condensation of the steam and isopentane vapour, affects the rate of reduction of the pressure in the chamber. The efficiency of the condenser unit may, for instance, be varied by varying the temperature of the water flowing through it or by varying the rate of flow of the water through it. It is, thus, possible to control the rate of change in the pressure in the chamber by controlling the rate of condensation of the steam and isopentane vapour in the condenser unit. The present invention is based on the discovery that the final filling value of the treated tobacco which depends on the expansion of the cell structure achieved can be controlled by control of the rate of change of pressure in the chamber during this stage of the process. The relationship between the filling value of the treated tobacco obtained and the rate of change of pressure in the chamber at this stage in the process appears to be linear over the range investigated. We have found that, to obtain a satisfactory filling value, the rate of change of pressure should be at least 100 mbar/minute (10 kPa/minute). Preferably, however, we would operate the system to achieve a rate of change of pressure of at least 300 mbar/minute (30 kpa/minute) and most preferably greater than 400 mbar/minute (40 kpa/minute) in order to achieve a high filling value. During this stage of the process the pressure is reduced to about 100–300 mbar (10–30 kPa) at which time the chamber is isolated and air is allowed to re-enter slowly to bring the pressure back to atmospheric.

The thus-treated tobacco after removal from the process chamber may then be pneumatically conveyed and, if required, blended in the usual way for cigar or cigarette production as required. Pneumatic conveying removes heat from the tobacco thereby fixing the expansion achieved. For this reason, an additional step in the process of the invention whereby the treated tobacco is pneumatically conveyed after leaving the process chamber forms a preferred embodiment.

In order to measure the filling value of a cured, threshed cigar tobacco product as described in the following examples, a filling value apparatus is used which is essentially composed of a cylinder 64 mm in diameter into which a piston 63 mm in diameter slides. The piston has a graduated scale on the side. Pressure is applied to the piston and volume in millilitres of a given weight of tobacco, 14.18 g is determined. Experiments have shown that this apparatus will accurately determine the filling value of a given amount of threshed cigar tobacco with good reproducibility. The pressure on the tobacco applied by the piston in all examples was 12.8 kPa applied for 10 minutes at which time the filling value reading was taken. The moisture content of the tobacco affects the filling values determined by this method, therefore comparative filling values were obtained at similar moisture contents.

EXAMPLE 1

150 kg of a cured, threshed cigar tobacco containing 14% moisture and having a filling value of 5 cc/g was arranged in baskets and treated according to the process of the invention in a treatment chamber. The pressure in the treatment chamber was reduced to a value of about 25 mbar (about 2.5 kPa) and then isopentane vapour having a temperature between 70° C. and 100° C. was pumped into the chamber raising the pressure in the chamber until a pressure of above 4.3 bar (430 kPa) was reached.

The tobacco was maintained in contact with the isopentane vapour for a further 30 minutes. All excess isopentane vapour was then removed from the chamber by reducing the pressure in the chamber over a period of about 15 minutes to a pressure of about 1.4 bar (140 kPa). Steam was then introduced into the chamber until a pressure of about 3 bar (300 kPa) was reached. The time taken for this pressure to be attained was about 2 minutes. After this, the pressure in the chamber was reduced at a rate of 150 mbar/minute (15 kPa/min) as steam and isopentane vapour were removed from the chamber and passed to the condenser. The pressure was reduced to about 200 mbar (20 kPa) at which point air was allowed to enter the chamber to bring the pressure back to atmospheric pressure. The pressure values employed within the treatment chamber are shown in FIG. 1.

After removal of the treated tobacco from the chamber its final filling value was measured to be 7.4 cc/g.

EXAMPLE 2

Figure 2:
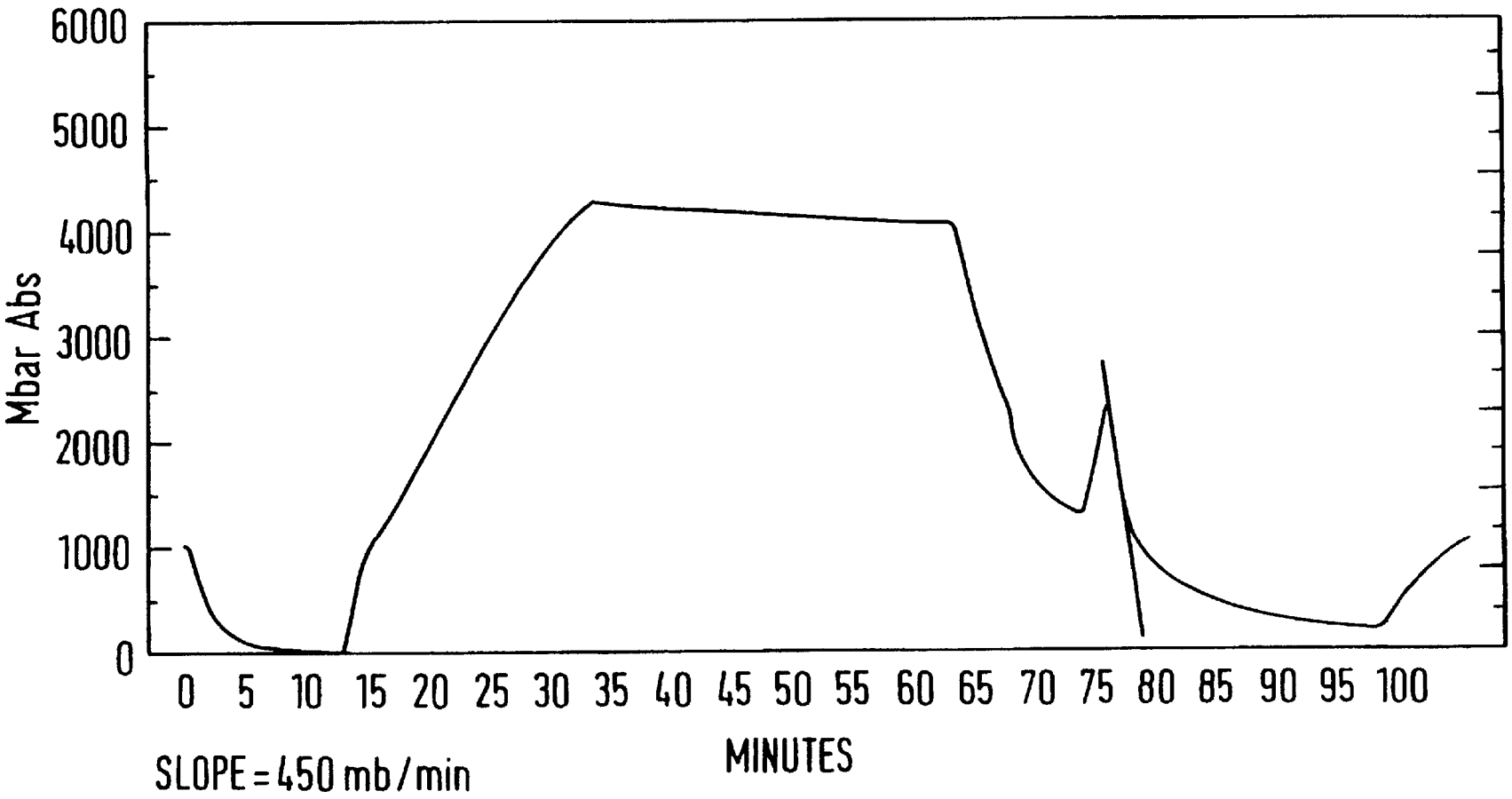

The procedure of Example 1 was repeated on another sample of the same untreated tobacco with the exception that after the introduction of steam into the chamber the pressure in the chamber was reduced at a rate of 450 mbar/minute (45 kPa/minute). The pressure values employed within the treatment chamber during this Example are shown in FIG. 2. After removal of the treated tobacco from the chamber its final filling value was measured to be 8.2 cc/g.

EXAMPLE 3

The relationship between the final filling value of tobacco treated according to the invention and the rate at which the pressure in the treatment chamber following the steam treatment of the impregnated tobacco is reduced was investigated. The investigation was carried out by repeating the procedure of Example 1 several times but in each case a different rate of pressure reduction in the treatment chamber following the steaming of the tobacco was used. The rate of pressure reduction was varied from one trial to the next by varying the rate at which the mixture of steam and isopentane vapour, withdrawn from the treatment chamber, was condensed in the condenser unit of the apparatus used. By increasing the efficiency of the condenser unit the rate of change in pressure in the treatment chamber may be increased.

In carrying out the trials one of four levels of condenser efficiency was employed. The four levels were:

| Efficiency level (decreasing) | Method |
|---|---|
| 1 (max) | full chilled water is circulated through the condenser from the end of excess isopentane removal stage to end of pressure reduction stage. |
| 2 | chilled water is circulated through the condenser throughout pressure reduction stage. |
| 3 | chilled water is circulated through the condenser when the rate of change of pressure in the treatment chamber drops to 267 mbar/minute. |
| 4 | chilled water is circulated through the condenser when the rate of change of pressure in the treatment chamber drops to 133 mbar (minute) |

The rate of change of pressure in the pressure reduction stage was determined from the monitored pressure vs time profile and recorded in each case. The results of the trials are set out in the following Table.

TABLE

| Trial No. | Efficiency Level | Rate of Change of pressure (mbar/min) | Average (total) filling value |
|---|---|---|---|
| 1 | 1 | 313 | 7.77 |
| 2 | 1 | 633 | 8.41 |
| 3 | 2 | 520 | 7.73 |
| 4 | 2 | 450 | 7.38 |
| 5 | 3 | 317 | 7.93 |
| 6 | 3 | 343 | 7.93 |
| 7 | 1 | 375 | 8.05 |
| 8 | 1 | 303 | 7.52 |
| 9 | 1 | 303 | 7.75 |
| 10 | 2 | 400 | 8.54 |
| 11 | 2 | 400 | 7.94 |
| 12 | 3 | 280 | 7.43 |
| 13 | 3 | 287 | 7.73 |
| 14 | 4 | 202 | 7.73 |
| 15 | 4 | 216 | 7.67 |
| 16 | 4 | 150 | 6.92 |
| 17 | 4 | 134 | 7.32 |
| 18 | 4 | 165 | 6.75 |
| 19 | 4 | 211 | 7.89 |
| 20 | 4 | 156 | 7.32 |
| 21 | 4 | 205 | 7.27 |
| 22 | 4 | 213 | 7.49 |

Figure 3:
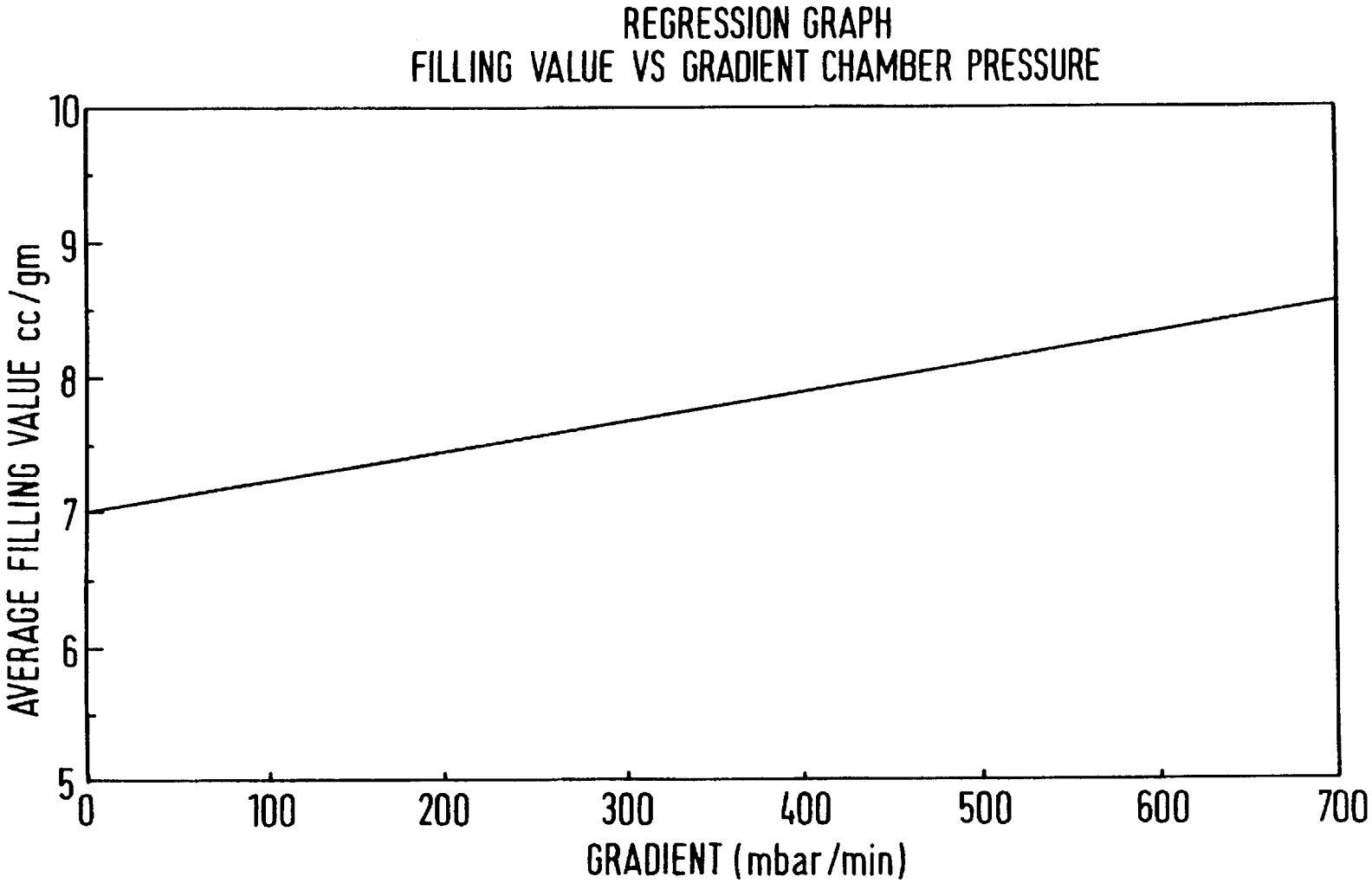

The total average filling values obtained were plotted against the rate of change of pressure used in the pressure reduction stage and the best fit line drawn through these. This is shown in FIG. 3. According to the results obtained and the best fit line shown in FIG. 3 the filling value (FV) of the treated tobacco is related to the rate of change of pressure in the chamber following steam treatment of the tobacco (RCP) by the following expression:

$$FV=2.221\times10^{-3}\times RCP+6.997$$

What is claimed is:

1. A process for treating tobacco comprising the series of steps:

(1) subjecting in a chamber the tobacco to a reduced pressure of not greater than 70 mbar (7 kPa);

(2) introducing, into the chamber, isopentane vapour at a temperature in the range of from 70° C. to 100° C. and maintaining the tobacco in contact with isopentane vapour at a pressure of at least 4 bar (400 kPa) to cause impregnation of the tobacco;

(3) removing excess isopentane vapour by depressurising the chamber, without causing damage to the cell structure in the tobacco;

(4) contacting the impregnated tobacco with steam to expand the tobacco;

(5) reducing the pressure in the chamber at a rate of at least 100 mbar/minute (10 kPa/minute); and (6) venting the chamber back to atmospheric pressure.

2. A process according to claim 1, wherein in step (1) the tobacco is subjected to a reduced pressure below 25 mbar (2.5 kPa).

3. A process according to claim 1, wherein in step (2) the tobacco is maintained in contact with the isopentane vapour at a pressure in the range of 4000–5200 mbar (400–520 kPa) for at least 30 minutes.

4. A process according to claim 1, wherein in step (4) the steam is introduced into the chamber to raise the pressure to a value of from 2200 to 3000 mbar (220–300 kPa).

5. A process according to claim 4, wherein the rate of change of pressure in step 5 in the process is at least 300 mbar/minute (30 kPa/minute).

* * * * *